US008795798B2

(12) United States Patent
Oguri et al.

(10) Patent No.: US 8,795,798 B2
(45) Date of Patent: Aug. 5, 2014

(54) RECORDING MEDIUM AND METHOD FOR PRODUCING RECORDING MEDIUM

(75) Inventors: Isamu Oguri, Yokohama (JP); Hisao Kamo, Ushiku (JP); Yasuhiro Nito, Yokohama (JP); Tetsuro Noguchi, Hachioji (JP); Ryo Taguri, Sagamihara (JP); Olivia Herlambang, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/950,421

(22) Filed: Nov. 19, 2010

(65) Prior Publication Data

US 2011/0135855 A1 Jun. 9, 2011

(30) Foreign Application Priority Data

Dec. 8, 2009 (JP) ..... 2009-278463

(51) Int. Cl.
*B41M 5/00* (2006.01)
*B41M 5/50* (2006.01)
*B41M 5/52* (2006.01)

(52) U.S. Cl.
CPC ..... *B41M 5/502* (2013.01); *B41M 5/50* (2013.01); *B41M 5/00* (2013.01); *B41M 5/5245* (2013.01); *B41M 5/5218* (2013.01); *B41M 5/506* (2013.01)
USPC ..... 428/32.25; 428/32.28; 428/32.34; 428/32.38; 427/419.3

(58) Field of Classification Search
CPC ..... B41M 5/00; B41M 5/50; B41M 5/502; B41M 5/506; B41M 5/5218; B41M 5/5245
USPC ..... 427/407.1, 402, 411, 412.1, 419.2, 427/419.3; 428/32.1, 32.24, 32.25, 32.28, 428/32.34, 32.38
See application file for complete search history.

(56) References Cited

U.S. PATENT DOCUMENTS

| | | | |
|---|---|---|---|
| 4,434,226 | A | 2/1984 | Wilgus et al. |
| 5,463,178 | A | 10/1995 | Suzuki et al. |
| 5,576,088 | A | 11/1996 | Ogawa et al. |
| 5,635,291 | A | 6/1997 | Yoshino et al. |
| 5,750,200 | A | 5/1998 | Ogawa et al. |
| 5,800,916 | A | 9/1998 | Yoshino et al. |
| 5,846,647 | A | 12/1998 | Yoshino et al. |
| 5,851,654 | A | 12/1998 | Yoshino et al. |
| 5,869,177 | A | 2/1999 | Yoshino et al. |
| 5,955,185 | A | 9/1999 | Yoshino et al. |
| 5,962,124 | A | 10/1999 | Yoshino et al. |
| 5,965,252 | A | 10/1999 | Santo et al. |
| 6,342,289 | B1 | 1/2002 | Eguchi et al. |
| 6,558,740 | B1 | 5/2003 | Santo et al. |
| 6,649,661 | B2 | 11/2003 | Yoshino et al. |
| 6,685,999 | B2 | 2/2004 | Ichinose et al. |
| 6,874,881 | B2 | 4/2005 | Suzuki et al. |
| 6,929,362 | B2 | 8/2005 | Takada et al. |
| 6,932,465 | B2 | 8/2005 | Nito et al. |
| 6,935,732 | B2 | 8/2005 | Takada et al. |
| 7,029,109 | B2 | 4/2006 | Shirota et al. |
| 7,055,943 | B2 | 6/2006 | Suzuki et al. |
| 7,144,613 | B2 | 12/2006 | Eguchi et al. |
| 7,208,032 | B2 | 4/2007 | Hakamada et al. |
| 7,276,110 | B2 | 10/2007 | Tsujimura et al. |
| 7,276,112 | B2 | 10/2007 | Tokuda et al. |
| 7,347,890 | B2 | 3/2008 | Nito et al. |
| 7,354,145 | B2 | 4/2008 | Nito et al. |
| 7,377,631 | B2 | 5/2008 | Takada et al. |
| 7,402,200 | B2 | 7/2008 | Imai et al. |
| 7,416,639 | B2 | 8/2008 | Yoshino et al. |
| 7,517,073 | B2 | 4/2009 | Nito et al. |
| 7,517,074 | B2 | 4/2009 | Hakamada et al. |
| 7,537,329 | B2 | 5/2009 | Nito et al. |
| 7,625,614 | B2 | 12/2009 | Kamo et al. |
| 7,635,182 | B2 | 12/2009 | Hakamada et al. |
| 7,846,516 | B2 | 12/2010 | Kamo et al. |
| 7,867,586 | B2 | 1/2011 | Kamo et al. |
| 7,972,665 | B2 * | 7/2011 | Ogata et al. ..... 428/32.18 |

(Continued)

FOREIGN PATENT DOCUMENTS

| | | | |
|---|---|---|---|
| EP | 0 701 904 | A1 | 3/1996 |
| JP | 58-113927 | A | 7/1983 |
| JP | 5-016015 | B2 | 3/1993 |
| JP | 7-076162 | A | 3/1995 |
| JP | 07-101142 | A | 4/1995 |
| JP | 7-232473 | A | 9/1995 |

(Continued)

OTHER PUBLICATIONS

EPO Machine Translation of JP 2000-247022 A, generated May 8, 2014, 65 pages.*
Josef Rocek, et al., "Porous structure of aluminium hydroxide and its content of pseudoboehmite," Applied Catalysis, vol. 74 (1991), pp. 29-36.
Polymer Structure (2); Scattering Experiments and Morphological Observation; the First Chapter: Light Scattering (Kyoritsu Shuppan, edited by the Society of Polymer Science, Japan), pp. 126-127.
Esin Gulari, et al., "Photon correlation spectroscopy of particle distributions," J. Chem. Phys., vol. 70, No. 8 (Apr. 15, 1979), pp. 3965-3972.
Feb. 11, 2011 European Search Report in European Patent Appln. No. 10014920.2.

*Primary Examiner* — William Phillip Fletcher, III
(74) *Attorney, Agent, or Firm* — Fitzpatrick, Cella, Harper & Scinto

(57) ABSTRACT

A method for producing a recording medium, including a step of coating one or more ink receiving layers provided on at least one surface of a substrate with an outermost layer coating liquid to form an outermost layer, where an ink receiving layer of the one or more ink receiving layers, which is nearest to the outermost layer contains alumina hydrate and a binder. The outermost layer coating liquid contains monodispersive and spherical cationic colloidal silica particles having an average particle size of 30 nm or more and 60 nm or less, polyvinyl alcohol having a saponification degree of 75% by mol or more and 85% by mol or less and a viscosity-average polymerization degree of 1,500 or more and 2,200 or less, and cationic polyurethane emulsion particles having an average particle size of 10 nm or more and 100 nm or less.

7 Claims, No Drawings

(56) References Cited

U.S. PATENT DOCUMENTS

| | | | | |
|---|---|---|---|---|
| 2005/0008794 | A1* | 1/2005 | Graczyk et al. | 428/32.24 |
| 2008/0152827 | A1 | 6/2008 | Hakamada et al. | |
| 2008/0241436 | A1* | 10/2008 | Kobayashi | 428/32.22 |
| 2010/0075046 | A1 | 3/2010 | Hakamada et al. | |
| 2011/0008553 | A1 | 1/2011 | Hyakuda et al. | |

FOREIGN PATENT DOCUMENTS

| | | | | |
|---|---|---|---|---|
| JP | 8-132731 | A | | 5/1996 |
| JP | 9-066664 | A | | 3/1997 |
| JP | 9-076628 | A | | 3/1997 |
| JP | 2000-247022 | A | * | 9/2000 |
| JP | 2007-136777 | A | | 6/2007 |

* cited by examiner

RECORDING MEDIUM AND METHOD FOR PRODUCING RECORDING MEDIUM

BACKGROUND OF THE INVENTION

1. Field of the Invention

The present invention relates to a recording medium such as an ink jet recording medium and a method for producing the recording medium.

2. Description of the Related Art

In recent years, speeding up of printing has been advanced in addition to formation of high-quality images owing to technical innovation in ink jet printers. With this innovation, ink jet recording media have been required to have high-speed ink absorbency in addition to the property of providing high-quality images. In addition, there has been a strong demand for glossiness for giving texture comparable with that of a silver salt photograph.

In order to meet such requirements, an inorganic pigment such as finer silica particles or alumina hydrate particles has come to be used in an ink receiving layer of an ink jet recording medium with the pigment held by a polymer binder such as polyvinyl alcohol. Among the inorganic pigments, the alumina hydrate allows forming a receiving layer with a less amount of a binder, and so the receiving layer is excellent in ink absorbency. On the other hand, the damage resistance of the resulting ink receiving layer may be lowered in some cases when the alumina hydrate is used. In order to solve such a phenomenon, the following proposals have been made.

For example, Japanese Patent Application Laid-Open No. H07-76162 has proposed an ink jet recording medium obtained by providing a silica gel layer formed of colloidal silica and a water-soluble binder on an alumina receiving layer having a boehmite structure. Japanese Patent Application Laid-Open No. 2000-247022 has proposed a recording medium obtained by providing a porous layer formed of colloidal silica and a resin emulsion on an alumina receiving layer having a boehmite structure. Japanese Patent Application Laid-Open No. H07-101142 has proposed an ink jet recording sheet obtained by providing a gloss developing layer formed of colloid particles and a polymer latex. Japanese Patent Application Laid-Open No. 2007-136777 has proposed an ink jet recording sheet obtained by providing a gloss protecting layer formed of a fine pigment and a binder.

SUMMARY OF THE INVENTION

The above proposals are all intended to improve damage resistance or glossiness. With the higher speeding up of printing and formation of higher-quality images in recent years, however, in some cases, these proposals may not achieve ink absorbency and colorability, which can meet these technical innovations, at the same time, and it seems to still leave problems to be solved.

It is an object of the present invention to provide a recording medium good in ink absorbency, excellent in damage resistance and glossiness and good in colorability and anti-dusting.

According to the present invention, there is provided a method for producing a recording medium, comprising a step of coating one or more ink receiving layers provided on at least one surface of a substrate with an outermost layer coating liquid to form an outermost layer, an ink receiving layer, of said one or more ink receiving layers, which is nearest to the outermost layer containing alumina hydrate and a binder, wherein the outermost layer coating liquid contains monodispersive and spherical cationic colloidal silica particles having an average particle size of 30 nm or more and 60 nm or less, polyvinyl alcohol having a saponification degree of 75% by mol or more and 85% by mol or less and a viscosity-average polymerization degree of 1,500 or more and 2,200 or less, and cationic polyurethane emulsion particles having an average particle size of 10 nm or more and 100 nm or less. According to the present invention, there is also provided a recording medium obtained according to such a method for producing a recording medium.

According to the present invention, there can be provided a method for producing a recording medium good in ink absorbency, excellent in damage resistance and glossiness and good in colorability and anti-dusting.

Further features of the present invention will become apparent from the following description of exemplary embodiments.

DESCRIPTION OF THE EMBODIMENTS

Preferred embodiments of the present invention will now be described in detail.

The method for producing a recording medium according to the present invention includes a step of coating one or more ink receiving layers provided on at least one surface of a substrate with an outermost layer coating liquid to form an outermost layer. An ink receiving layer, of said one or more ink receiving layers, which is nearest to the outermost layer contains alumina hydrate and a binder. In addition, the method for producing a recording medium according to the present invention includes, as a preferred embodiment, coating at least one surface of a substrate with an ink receiving layer coating liquid containing alumina hydrate and a binder to form an ink receiving layer.

<Substrate>

As the substrate, may be favorably used a substrate composed of, for example, paper such as cast-coated paper, baryta paper or resin-coated paper (resin-coated paper with both surfaces thereof coated with a resin such as polyolefin), or a film. As this film, may be used any one of films of, for example, the following transparent thermoplastic resins: polyethylene, polypropylene, polyester, polylactic acid, polystyrene, polyacetate, polyvinyl chloride, cellulose acetate, polyethylene terephthalate, polymethyl methacrylate and polycarbonate. Besides, non-sized paper that is moderately sized paper or coat paper, or a sheet-like material (synthetic paper or the like) formed of a film opacified by filling an inorganic material or by fine foaming may also be used. In addition, a sheet formed of a glass or a metal may also be used. Further, the surfaces of these substrates may also be subjected to a corona discharge treatment or various undercoating treatments for the purpose of improving adhesion strength between such a substrate and the resulting ink-receiving layer. Among the above-described substrates, the resin-coated paper is favorably used. When the resin-coated paper is used, the quality of the resulting recording medium, such as a glossy feeling, can be improved.

When image quality and feel comparable with those of a silver salt photograph are intended to be achieved for a recording medium, examples of base paper favorably used as the substrate include the following. More specifically, polyolefin-resin-coated paper with at least one surface (front surface side), on which the ink receiving layer is provided, coated with a polyolefin resin is favorable, and polyolefin-resin-coated paper both surfaces of which are coated with a polyolefin resin is more favorable. The polyolefin-resin-coated paper is favorably such that the 10-point average roughness according to JIS B 0601 is 0.5 μm or less, and the 60°-specular glossiness according to JIS Z 8741 is 25% or more and 75% or less.

No particular limitation is imposed on the thickness of the resin-coated paper. However, the thickness is favorably 25 μm or more and 500 μm or less. When the thickness of the resin-coated paper is 25 μm or more, it can be well prevented that the stiffness of the resulting recording medium becomes low, and that such inconveniences that feel and texture when the recording medium is touched with a hand are deteriorated and the opacity is lowered occur. When the thickness of the resin-coated paper is 500 μm or less on the other hand, it can be well prevented that the resulting recording medium becomes rigid and hard to handle, so that paper feeding and conveyance in a printer can be smoothly conducted. The more favorable range of the thickness of the resin-coated paper is 50 μm or more and 300 μm or less. No particular limitation is also imposed on the basis weight of the resin-coated paper. However, the basis weight is favorably 25 g/m$^2$ or more and 500 g/m$^2$ or less. Incidentally, the substrate used in the present invention is favorably a non-gas-permeable substrate (resin-coated paper) from the viewpoint of surface smoothness.

<Ink Receiving Layer>

In the present invention, the ink receiving layer is formed on one surface or both surfaces of the substrate. In the present invention, an ink receiving layer, of one or more ink receiving layers, which is nearest to an outermost layer contains alumina hydrate and a binder. Thus, according to the present invention, there can be suitably produced, for example, a recording medium in which a substrate, an ink receiving layer containing an alumina hydrate and a binder and the outermost layer are provided in this order as viewed from the substrate side. In the present invention, a recording medium in which a substrate, an ink receiving layer containing colloidal silica particles and a binder, an ink receiving layer containing an alumina hydrate and a binder and an outermost layer are provided in this order in the above-described embodiment can also be suitable produced.

[Ink Receiving Layer Coating Liquid]

In the present invention, it is favorable that an ink receiving layer coating liquid containing alumina hydrate and a binder is applied to form an ink receiving layer, of one or more ink receiving layers, which is nearest to an outermost layer. As a process for coating the substrate with the ink receiving layer coating liquid, may be applied any conventionally known coating process. For example, coating by a coating method such as a blade coating, air-knife coating, curtain die coating, slot die coating, bar coating, gravure coating or roll coating method is feasible. The two or more ink receiving layers may be formed by sequential coating or simultaneous multi-layer coating liquid of coating liquids for forming the respective layers. In particular, simultaneous multi-layer coating liquid by a slide bead system is a favorable method in that productivity is high. After the ink receiving layer is formed, i.e., the ink receiving layer coating liquid is applied, drying is conducted by means of a drying device such as a hot air dryer, heated drum or far infrared dryer, whereby the ink receiving layer is favorably cured. In order to improve the resolution of an image formed on the ink receiving layer and conveyability of the resulting recording medium, the ink receiving layer may also be subjected to a smoothing treatment by means of a device such as a calender or cast device within limits not impeding the effects of the present invention.

The coating amount of the ink receiving layer coating liquid is favorably 5 g/m$^2$ or more and 50 g/m$^2$ or less in terms of absolute dry coating amount though it varies according to necessary ink absorption capacity, glossiness and the composition of the receiving layer. When the coating amount is 5 g/m$^2$ or more, it can be prevented that the ink absorbency of the resulting ink receiving layer becomes low. When the coating amount is 50 g/m$^2$ or less, it can be prevented that the fold crack resistance of the resulting ink receiving layer becomes low.

Alumina Hydrate

As the alumina hydrate added into the ink receiving layer coating liquid, is favorably used, for example, that represented by the following general formula (X):

$$Al_2O_{3-n}(OH)_{2n}.mH_2O \quad (X)$$

wherein n is any one of 1, 2 and 3, and m is a number of 0 or more and 10 or less, favorably 0 or more and 5 or less, with the proviso that n and m are not 0 at the same time.

In many cases, $mH_2O$ represents an aqueous phase, which does not participate in the formation of a crystal lattice, but is eliminable. Therefore, m may take a value of an integer or a value other than an integer. When the alumina hydrate is heated, m may reach a value of 0 in some cases. The content of the alumina hydrate in the ink receiving layer coating liquid is favorably 70% by mass or more and 95% by mass or less based on the total solid content in the ink receiving layer coating liquid. The content of the alumina hydrate in the ink receiving layer formed by applying the ink receiving layer coating liquid is equal to the solid content of the alumina hydrate based on the total solid content in such coating liquid. In other words, the content of the alumina hydrate based on the total solid content in the ink receiving layer is favorably 70% by mass or more and 95% by mass or less.

As the crystal structure of the alumina hydrate, are known amorphous, gibbsite and boehmite type according to the temperature of a heat treatment. That having any crystal structure among these structures may be used. Among these, favorable alumina hydrate is alumina hydrate exhibiting a beohmite structure or amorphous structure when analyzed by the X-ray diffractometry. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628. In addition, commercially available Disperal HP14 (trade name, product of Sasol Co.) may be mentioned as the alumina hydrate. Incidentally, 2 or more kinds of alumina hydrates may be used in combination. The BET specific surface area of the alumina hydrate is favorably 100 m$^2$/g or more and 200 m$^2$/g or less, more favorably 125 m$^2$/g or more and 175 m$^2$/g or less, as measured by the BET method. When the alumina hydrate having a BET specific surface area of 100 m$^2$/g or more and 200 m$^2$/g or less is used, the average pore radius of the resulting ink receiving layer can be controlled within a range of 7 nm or more and 10 nm or less. When the average pore radius of the ink receiving layer is 7 nm or more and 10 nm or less, the resulting recording medium can exhibit excellent ink absorbency and colorability. When the average pore radius of the ink receiving layer is 7 nm or more, it can be prevented that the ink absorbency of the ink receiving layer is lowered. When the average pore radius of the ink receiving layer is 10 nm or less, good colorability can be achieved. In the present invention, the average pore radium of the ink receiving layer is favorably 8.0 nm or more and 10 nm or less.

The BET method is a method for measuring the surface area of powder by a gas-phase adsorption method, and is a method for determining a total surface area that 1 g of a sample has, i.e., a specific surface area, from an adsorption isotherm. In the BET method, nitrogen gas is generally used as an adsorption gas, and a method of measuring an adsorption amount from a change in the pressure or volume of the gas to be adsorbed is oftenest used. At this time, the Brunauer-Emmett-Teller equation is most marked as that indicating the isotherm of multimolecular adsorption, called the BET equation, and widely used in determination of the specific surface area. According to the BET method, the specific surface area is determined by finding an adsorption amount based on the BET equation and multiplying this value by the area occupied by a molecule adsorbed at the surface. In the BET method, the relationship between a certain relative pressure and an absorption amount is determined several times, and the slope and intercept of plots thereof are found by the least square method to derive the specific surface area. In order to raise the precision of measurement, it is thus better that the relationship between the relative pressure and the absorption amount is determined favorably 5 times, more favorably 10 times.

The average pore radius is a value determined by means of the BJH (Barrett-Joyner-Halenda) method from an adsorption-desorption isotherm of nitrogen gas obtained by subjecting an ink receiving layer to measurement by the nitrogen adsorption-desorption method. Specifically, the average pore radius is a value determined by calculation from the whole pore volume measured upon desorption of nitrogen gas and a specific surface area.

When the recording medium is subjected to the measurement by the nitrogen adsorption-desorption method, the measurement is conducted even for other portions than the ink receiving layer. However, other components (for example, a pulp layer and a resin coating layer of the substrate) than the ink receiving layer do not have pores of 1.0 nm or more and 100.0 nm or less that is a range generally measurable by the nitrogen adsorption-desorption method. Therefore, it is considered that even when the whole recording medium is subjected to the measurement by the nitrogen adsorption-desorption method, the average pore radius of the ink receiving layer comes to be measured. Incidentally, this can be understood from the fact that when the pore distribution of resin-coated paper is measured by the nitrogen adsorption-desorption method, the resin-coated paper does not have pores of 1.0 nm or more and 100.0 nm or less.

As the alumina hydrate, is favorably used alumina hydrate having an average aspect ratio of 3.0 or more and 10 or less and a maximum-diameter to minimum-diameter ratio of the flat plate surface of 0.60 or more and 1.0 or less. Incidentally, the aspect ratio can be determined according to the method described in Japanese Patent Publication No. H05-16015. More specifically, the aspect ratio is expressed by a ratio of "diameter" to "thickness" of a particle. The term "diameter" as used herein means a diameter (equivalent circle diameter) of a circle having an area equal to the projected area of the particle, which has been obtained by observing the alumina hydrate through a microscope or electron microscope. The maximum-diameter to minimum-diameter ratio of the flat plate surface means a ratio of a diameter indicating a minimum value to a diameter indicating a maximum value in the flat plate surface when the particle is observed through the microscope in the same manner as in the aspect ratio.

When the alumina hydrate having an aspect ratio of from 3.0 or more and 10 or less is used, it can be well prevented that the pore distribution range of an ink receiving layer to be formed becomes narrow. It can thus be possible to produce alumina hydrate with its particle size uniform. When the alumina hydrate having a maximum-diameter to minimum-diameter ratio of 0.60 or more and 1.0 or less is used, it can also be well prevented likewise that the pore distribution range of an ink receiving layer to be formed becomes narrow.

The alumina hydrate favorably has a flat plate form. As described in the literature [Rocek J., et al., Applied Catalysis, Vol. 74, pp. 29-36 (1991)], it is generally known that alumina hydrates include those having a ciliary form and those having another form. According to the finding by the present inventors, an alumina hydrate having a flat plate form has better dispersibility than that having a ciliary form even when the alumina hydrates are those of the same kind. The alumina hydrate of the ciliary form tends to orient in parallel to the surface of the substrate upon coating, and pores in an ink receiving layer to be formed may become small in some cases, and so the ink absorbency of the ink receiving layer may become low. On the other hand, the alumina hydrate of the flat plate form has a little tendency to orient in parallel to the surface of the substrate upon coating, which has a particularly good influence on the size of pores and ink absorbency of an ink receiving layer to be formed.

Dispersion Liquid Containing Alumina Hydrate

The alumina hydrate is favorably contained in the ink receiving layer coating liquid in a state of an aqueous dispersion deflocculated by a deflocculant. In the present invention, aqueous dispersions in which alumina hydrate and alumina are deflocculated by the deflocculant are referred to as an aqueous alumina hydrate dispersion and an aqueous alumina dispersion, respectively. The aqueous dispersion containing the alumina hydrate may contain a pigment dispersant, a thickener, a flowability modifier, an antifoaming agent, a foam inhibitor, a surfactant, a parting agent, a penetrant, a coloring pigment, a coloring dye, a fluorescent whitening agent, an ultraviolet absorbent, an antioxidant, a preservative, a mildew-proofing agent, a water-proofing agent, a dye fixer, a hardener and/or a weathering agent as needed. As a dispersion medium of the aqueous dispersion containing the alumina hydrate, is favorably used water. In the present invention, an acid (deflocculating acid) is favorably used as the flocculant. The deflocculating acid is favorably a sulfonic acid represented by the following general formula [I] from the viewpoint of image bleeding resistance.

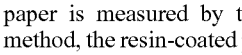

$R^1—SO_3H$ General formula [I]

[In the general formula [I], $R^1$ is a branched or unbranched alkyl or alkenyl group having 1 to 3 carbon atoms, with the proviso that $R^1$ may have at least one of an oxo group, halogen atoms, an alkoxy group (—OR) and an acyl group (R—CO—) as a substituent. R in these substituents is a hydrogen atom or an alkyl group having 1 or 2 carbon atoms, with the proviso that R is not a hydrogen atom when the substituent is an alkoxy group].

Binder

The ink receiving layer coating liquid contains a binder. No particular limitation is imposed on a usable binder so far as it is a material capable of binding the alumina hydrate and forming a coating and does not impair the effects of the present invention. Examples of the binder include the following binders: starch derivatives such as oxidized starch, etherified starch and phosphoric acid-esterified starch; cellulose derivatives such as carboxymethyl cellulose and hydroxyethyl cellulose; casein, gelatin, soybean protein and polyvinyl alcohol and derivatives thereof; polyvinyl pyrrolidone, maleic anhydride resins, latexes of conjugated polymers such as styrene-butadiene copolymers and methyl methacrylate-butadiene copolymers, latexes of acrylic polymers such as acrylic ester and methacrylic ester polymers, and latexes of vinyl polymers such as ethylene-vinyl acetate copolymers as various kinds of polymers; functional-group-modified polymer latexes obtained by modifying the above-described polymers with a monomer containing a functional group such as a carboxyl group; cationized polymers obtained by cationizing the above-described polymers with a cationic group or cationizing the surfaces of the polymers with a cationic surfactant; polymers on the surfaces of which polyvinyl alcohol has been distributed obtained by polymerizing the above-described polymers in cationic polyvinyl alcohol; polymers on the surfaces of which cationic colloid particles have been distributed obtained by polymerizing the above-described polymers in a suspended dispersion of the cationic colloid particles; aqueous binders such as thermosetting synthetic resins such as melamine resins and urea resins; polymer or copolymer resins of acrylic esters and methacrylic esters, such as polymethyl methacrylate; and synthetic resin binders such as polyurethane resins, unsaturated polyester resins, vinyl chloride-vinyl acetate copolymers, polyvinyl butyral and alkyd resins.

The binders may be used either singly or in any combination thereof. Among these, polyvinyl alcohol (PVA) is most favorably used. This polyvinyl alcohol can be synthesized by, for example, hydrolyzing polyvinyl acetate. The viscosity-average polymerization degree of polyvinyl alcohol is favorably 1,500 or more, more favorably 2,000 or more and 5,000 or less. The saponification degree of polyvinyl alcohol is favorably 80% by mol or more and 100% by mol or less, more favorably 85% by mol or more and 100% by mol or less. The content of polyvinyl alcohol in the ink receiving layer coating liquid is favorably 5 parts by mass or more and 30 parts by mass or less in terms of solid content per 100 parts of the alumina hydrate. Besides the above, modified polyvinyl alcohol such as polyvinyl alcohol with a terminal thereof cationically modified or anionically modified polyvinyl alcohol having an anionic group may also be used.

Crosslinking Agent

A crosslinking agent may be added into the ink receiving layer coating liquid. Specific examples of the crosslinking agent include aldehyde compounds, melamine compounds, isocyanate compounds, zirconium compounds, amide compounds, aluminum compounds, boric acid and boric acid salts. The crosslinking agent is favorably at least one of these compounds. Among these, boric acid and boric acid salts are particularly favorable as the crosslinking agent from the viewpoints of crosslinking rate and prevention of cracking of a coating surface. Examples of boric acid usable include not only orthoboric acid ($H_3BO_3$) but also metaboric acid and hypoboric acid. The boric acid salt is favorably a water-soluble salt of the boric acid. As specific examples of the boric acid salt, may be mentioned the following boric acid salts: alkali metal salts such as the sodium salts ($Na_2B_4O_7.10H_2O$ and $NaBO_2.4H_2O$) of boric acid and the potassium salts ($K_2B_4O_7.5H_2O$ and $KBO_2$) of boric acid; the ammonium salts ($NH_4B_4O_9.3H_2O$ and $NH_4BO_2$) of boric acid; and the magnesium salts and calcium salts of boric acid.

Among these boric acids and boric acid salts, orthoboric acid is favorably used from the viewpoints of long-term stability of the resulting ink receiving layer coating liquid and an inhibitory effect on occurrence of cracking. The content of the boric acid and boric acid salt in the ink receiving layer coating liquid is favorably 10.0% by mass or more and 50.0% by mass or less based on the total mass of the binder in the ink receiving layer coating liquid. When the ink receiving layer is formed of or more ink receiving layers as described above, each layer favorably satisfies the above-described content of the boric acid and boric acid salt.

When the content of the boric acid and boric acid salt is 50.0% by mass or less, it can be well prevented that the long-term stability of the coating is lowered. In general, the coating liquid is used over a long period of time upon production of the recording medium. When the content of the boric acid and boric acid salt is 50.0% by mass or less, viscosity increase of the coating liquid, and occurrence of gelled products, which are caused when the content of boric acid is too high, can be well prevented even when the ink receiving layer coating liquid is used for a long period of time. Therefore, replacement of the coating liquid or cleaning of a coater head need not be frequently conducted, so that lowering of productivity can be prevented. In addition, when the content of the boric acid and boric acid salt is 50.0% by mass or less, it can be prevented that dotted surface defects become liable to occur on the resulting ink receiving layer, and so an uniform and particularly good glossy surface can be obtained. When the content of the boric acid and boric acid salt is 10.0% by mass or more, occurrence of cracks can be satisfactorily inhibited.

Other Additives

As needed, to the ink receiving layer coating liquid, may be added various kinds of additives, for example, fixers such as various kinds of cationic resins, flocculants such as polyvalent metal salts, surfactants, fluorescent whitening agents, thickeners, antifoaming agents, foam inhibitors, parting agents, penetrants, lubricants, ultraviolet absorbents, antioxidants, leveling agents, preservatives, pH adjustors, and various kinds of aids publicly known in the technical field of the present invention. The amounts of these additive added may be suitably adjusted. Examples of the cationic resins include polyethylene imine resins, polyamine resin, polyamide resins, polyamide epichlorohydrin resins, polyamine epichlorohydrin resins, polyamidopolyamine epichlorohydrin reins, polydiallylamine resins and dicyandiamide condensates. These water-soluble resins may be used either singly or in any combination thereof.

<Outermost Layer Coating Liquid>

The outermost layer coating liquid according to the present invention contains monodispersive and spherical cationic colloidal silica particles having an average particle size of 30 nm or more and 60 nm or less, polyvinyl alcohol having a saponification degree of 75% by mol or more and 85% by mol or less and a viscosity-average polymerization degree of 1,500 or more and 2,200 or less, and cationic polyurethane emulsion particles having an average particle size of 10 nm or more and 100 nm or less. In the present invention, the outermost layer coating liquid is applied on to the ink receiving layer containing the alumina hydrate and the binder, whereby an outermost layer can be formed. No particular limitation is imposed on a method for curing the outermost layer formed, and a publicly known drying method usable upon the curing of the ink receiving layer may be suitably used.

Various coating systems used in applying the ink receiving layer coating liquid may be used in applying the outermost layer coating liquid. The outermost layer coating liquid may be applied at the same time as the ink receiving layer is formed, at the time the ink receiving layer formed has been semi-cured, or after the ink receiving layer formed has been cured. However, the outermost layer coating liquid is favorably applied after the ink receiving layer has been cured for the purpose of avoiding the mixing of the ink receiving layer with the outermost layer. The absolute dry coating amount of the outermost layer coating liquid is favorably 0.1 $g/m^2$ or more and less than 0.5 $g/m^2$, more favorably 0.2 $g/m^2$ or more and less than 0.4 $g/m^2$. When the coating amount is 0.1 $g/m^2$ or more, the damage resistance of the resulting recording medium becomes particularly good. When the coating amount is less than 0.5 $g/m^2$, the ink absorbency of the resulting recording medium becomes particularly good.

Incidentally, to the outermost layer coating liquid, may be added various kinds of additives such as a thickener, an antifoaming agent, a dot adjuster, a preservative, a pH adjuster, an antistatic agent and a conductivity-imparting agent in addition to the cationic colloidal silica particles, polyvinyl alcohol and cationic polyurethane emulsion particles.

Cationic Colloidal Silica Particles

The outermost layer coating liquid according to the present invention contains the cationic colloidal silica particles, i.e., solids of colloidal silica. In the present invention, a dispersion liquid containing the cationic colloidal silica, i.e., cationic colloidal silica particles, may be suitably used for obtaining the outermost layer coating liquid containing the cationic colloidal silica particles. The outermost layer coating liquid containing the cationic colloidal silica is applied to (coated on) the ink receiving layer, whereby the outermost layer containing the cationic colloidal silica particles can be formed.

The cationic colloidal silica particles can be prepared by subjecting the surfaces of anionic colloidal silica particles to various inorganic or organic surface treatments to cationize the surfaces. Among others, cationic colloidal silica particles obtained by a surface treatment with alumina are favorably used from the viewpoint of stability of the resulting dispersion liquid and easy availability. The colloidal silica particles are cationic, whereby aggregation of the outermost layer coating liquid containing the cationic colloidal silica particles on the surface of the ink receiving layer can be inhibited when the coating is applied to the ink receiving layer, and so the colorability of the resulting recording medium becomes good. To the contrary, when a coating liquid containing anionic colloidal silica particles is applied, the aggregation of the coating liquid on the surface of the ink receiving layer occurs to lower the colorability.

The cationic colloidal silica particles used in the present invention are monodispersive and spherical. Incidentally, the term "monodispersive" means that plural particles in a dispersion liquid (cationic colloidal silica) do not associate, that is, the monodispersive cationic colloidal silica is the so-called cationic colloidal silica particles without association. If cationic colloidal silica particles associated into, for example, the form of a string of beads are used, the glossiness of the resulting recording medium is lowered. The term "spherical" as used herein means that when the major axis (a) and the minor axis (b) of a particle are determined (each, determined as an average value) from a photograph of the particle (50 or more and 100 or less particles are observed) taken by means of a scanning electron microscope, the ratio (b/a) of the major to minor axis falls within a range of 0.80 or more and 1.00 or less. The ratio (b/a) is favorably 0.90 or more and 1.00 or less, more favorably 0.95 or more and 1.00 or less. If b/a is less than 0.80, the glossiness of the resulting recording medium is lowered.

The average particle size of the cationic colloidal silica particles used in the present invention is 30 nm or more and 60 nm or less. If the average particle size of the cationic colloidal silica particles is less than 30 nm, the ink absorbency of the resulting recording medium is lowered. If the average particle size is greater than 60 nm, the glossiness of the resulting recording medium is particularly lowered. The average particle size of the cationic colloidal silica particles used in the present invention can be calculated by the following method. To be specific, the specific surface area of the cationic colloidal silica particles is measured by the same method as the above-described method for determining the specific surface area of the alumina hydrate, i.e. the BET method. And then the absolute specific gravity of the cationic colloidal silica particles is determined according to the method prescribed in JIS K0061. The average particle size D of the cationic colloidal silica particles can be calculated by the following equation (A) with the specific surface area S ($m^2/g$) and the absolute specific gravity ρ ($g/cm^3$) of the cationic colloidal silica particles.

$$\text{Average particle size } D \text{ (nm)} = 6000/(S \times \rho) \quad \text{(A)}$$

Examples of the cationic colloidal silica used in the present invention include SNOWTEX AK-L (trade name) available from NISSAN CHEMICAL INDUSTRIES, LTD.

The content of the colloidal silica particles based on the total mass of solids in the outermost layer coating liquid is favorably 70% by mass or more and 95% by mass or less. In the present invention, the solids in the outermost layer coating liquid means solids remaining after the outermost layer coating liquid is dried to remove water and a solvent. Therefore, the total mass of solids in the outermost layer coating liquid includes at least the mass of colloidal silica particles, the mass of polyvinyl alcohol and the mass of cationic polyurethane emulsion particles in the outermost layer coating liquid. Incidentally, the content of the colloidal silica particles in the outermost layer formed by applying the outermost layer coating liquid is equal to the content of the colloidal silica particles based on the total solid content in the outermost layer coating liquid. In other words, the content of the colloidal silica particles based on the total solid content in the outermost layer is favorably 70% by mass or more and 95% by mass or less. When the content is 70% by mass or more, it can be well prevented that the ink absorbency of the resulting recording medium is deteriorated. When the content is 95% by mass or less, it can be well prevented that dusting, which is such a phenomenon that the outermost layer peels off, occurs.

Polyvinyl Alcohol

The outermost layer coating liquid according to the present invention contains polyvinyl alcohol having a saponification degree of 75% by mol or more and 85% by mol or less and a viscosity-average polymerization degree of 1,500 or more and 2,200 or less. If the saponification degree is lower than 75% by mol, the water solubility of such polyvinyl alcohol is lowered and is hard to handle. If the saponification degree is higher than 85% by mol, aggregation of the cationic colloidal silica particles becomes uneven when the outermost layer coating liquid is applied, so that the colorability of the resulting recording medium is lowered. If the viscosity-average polymerization degree is lower than 1,500, the strength of the resulting coating film is lowered. If the viscosity-average polymerization degree is higher than 2,200, the colorability is lowered. The saponification degree of polyvinyl alcohol is a value measured by the method of JIS K 6726, and is chemically a proportion of the number of moles of a hydroxyl group formed by a saponification reaction when polyvinyl acetate is saponified to obtain polyvinyl alcohol. The average polymerization degree of polyvinyl alcohol means a viscosity-average polymerization degree determined by the method described in JIS K 6726 (1994).

The content of polyvinyl alcohol in the outermost layer coating liquid is favorably 3 parts by mass or more and 13 parts by mass or less, more favorably 4 parts by mass or more and 9 parts by mass or less, per 100 parts by mass of the cationic colloidal silica particles. When the content is 3 parts by mass or more, it can be well prevented that the strength of the resulting coating film is lowered. When the content is 13 parts by mass or less, it can be well prevented that the colorability and absorbency of the resulting recording medium are lowered. The polyvinyl alcohol used in the present invention includes PVA-417 and 420 (trade names) available from Kuraray Co., Ltd.

Cationic Polyurethane Emulsion Particles

The outermost layer coating liquid according to the present invention contains cationic polyurethane emulsion particles. In the present invention, cationic polyurethane in an emulsion state and a dispersion medium dispersing such cationic polyurethane are collectively referred to as a cationic polyurethane emulsion, and the cationic polyurethane in the emulsion state, i.e., a dispersoid, is referred to as cationic polyurethane emulsion particles. When anionic polyurethane emulsion particles are added in place of the cationic polyurethane emulsion particles, the colorability of the resulting recording medium is lowered. When water-soluble polyurethane is added, the glossiness of the resulting recording medium cannot be sufficiently improved. No particular limitation is imposed on a method for adding the cationic polyurethane emulsion particles in the outermost layer coating liquid. However, the cationic polyurethane emulsion in which the cationic polyurethane is dispersed in the emulsion state in the dispersion medium is favorably added to the outermost layer coating liquid.

The average particle size of the cationic polyurethane emulsion particles, i.e., the dispersoid in the cationic polyurethane emulsion, is 10 nm or more and 100 nm or less, favorably 10 nm or more and 70 nm or less. When the particle size is 10 nm or more, the glossiness of the resulting recording medium becomes good. When the particle size is 100 nm or less, the colorability of the resulting recording medium becomes good. Incidentally, the average particle size of the cationic polyurethane emulsion particles is an average particle size measured by the dynamic light scattering method and determined by the analysis using the Cumulant method described in "Structure (2) of Polymer; Scattering Experiments and Morphological Observation; First Chapter: Light Scattering" (KYORITSU SHUPPAN, edited by The Society of Polymer Science, Japan), or J. Chem. Phys., 70(B), 15 Apl., 3965 (1979). When the cationic polyurethane emulsion particles are used in combination with the cationic colloidal silica particles and polyvinyl alcohol, the colorability of the resulting recording medium becomes particularly good. Examples of the cationic polyurethane emulsion particles used in the present invention include SUPER FLEX 600, 610, 620 and 650 (trade names) available from DAI-ICHI KOGYO SEIYAKU CO., LTD., and HYDRAN CP-7030, 7050 and 7060 (trade names) available from DIC CORPORATION.

Polyurethane

Polyurethane used in preparation of the cationic polyurethane will hereinafter be described.

Examples of polyurethane applicable to the cationic polyurethane used in the present invention include various kinds of polyurethane synthesized by variously combining the following diol compounds and diisocyanate compounds and subjecting the combined compounds to a polyaddition reaction. The diol compounds and diisocyanate compounds usable in the synthesis of the polyurethane may be respectively used singly. Two or more compounds of the respective compounds may be used in any proportions according to various objects (for example, adjustment of a glass transition temperature (Tg) and improvement in solubility of the resulting polymer, imparting of compatibility with a binder, and improvement in stability of a dispersion).

Specific examples of the diol compounds include ethylene glycol, 1,2-propanediol, 1,3-propanediol, 1,2-butanediol, 1,3-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol, polyethylene glycol, polypropylene glycol, polyester polyol, 4,4'-dihydroxydiphenyl-2,2-propane and 4,4'-dihydroxyphenyl sulfone.

Specific examples of the diisocyanate compounds include methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-naphthalene diisocyanate, m-phenylene diisocyanate, p-phenylene diisocyanate, 3,3'-dimethyl-4,4'-diphenylmethane diisocyanate, 3,3'-dimethylbiphenylene diisocyanate, 4,4'-biphenylene diisocyanate, dicyclohexylmethane diisocyanate and methylenebis(4-cyclohexyl isocyanate).

Cationic Polyurethane

The cationic-group-containing polyurethane (cationic polyurethane) used in the cationic polyurethane emulsion can be obtained by, for example, using a diol having a cationic group upon the synthesis of the polyurethane. In this case, the cationic group is introduced into the polyurethane as a substituent of a main chain of the polymer, whereby the cationic polyurethane can be synthesized. The cationic group of the cationic polyurethane can be introduced into the polyurethane by various methods. The cationic polyurethane can also be synthesized by preparing polyurethane by a polyaddition reaction, and then causing a cationic-group-containing compound to react with a reactive group remaining at a terminal of the polyurethane, such as an —OH group or amino group, thereby introducing the cationic group. As examples of the cationic-group-containing compound, may be mentioned primary, secondary and tertiary amines and quaternary ammonium salts.

The content of the cationic group in the cationic polyurethane is favorably 0.1 mmol/g or more and 3.0 mmol/g or less, more favorably 0.2 mmol/g or more and 2.0 mmol/g or less. When the content of the cationic group in the cationic polyurethane is 0.1 mmol or more, it can be inhibited that the dispersion stability of the cationic polyurethane becomes low. When the content is 3.0 mmol or less, it can be inhibited that the compatibility of the cationic polyurethane with a binder is lowered.

The mass average molecular weight (Mw) of the cationic polyurethane is favorably 1,000 or more and 200,000 or less, more favorably 2,000 or more and 50,000 or less. When the mass average molecular weight is 1,000 or more, the cationic polyurethane can be provided as a particularly stable dispersion. When the mass average molecular weight is 200,000 or less, lowering of solubility and increase of liquid viscosity can be inhibited, and it can be inhibited that the average particle size of the particles in an aqueous dispersion of the cationic polyurethane becomes hard to be controlled to 100 nm or less in particular.

Cationic Polyurethane Emulsion

Water is favorably used as a dispersion medium of the cationic polyurethane emulsion. A preparation method of the aqueous dispersion (emulsion) of the cationic polyurethane using water as a dispersion medium will be described below. The cationic polyurethane is mixed with water that is a dispersion medium, additives such as a dispersant are mixed as needed, and the resultant mixture is granulated into fine particles by a dispersing machine, whereby an aqueous dispersion containing cationic polyurethane emulsion particles having an average particle size of 100 nm or less, i.e., a cationic polyurethane emulsion, can be obtained. As the dispersing machine used for obtaining this aqueous dispersion, may be used conventionally known various dispersing machines such as high-speed rotating dispersing machines, medium-stirring type dispersing machines (for example, ball mill, sand mill and bead mill), ultrasonic dispersing machines, colloid mill dispersing machines and high-pressure dispersing machines. However, medium-stirring type dispersing machines, colloid mill dispersing machines and high-pressure dispersing machines (homogenizers) are favorably used from the viewpoint of efficiently conducting the dispersion of the cationic polyurethane emulsion particles.

The content of the cationic polyurethane emulsion particles in the outermost layer coating liquid is favorably 3 parts by mass or more and 13 parts by mass or less, more favorably 4 parts by mass or more and 9 parts by mass or less, per 100 parts by mass of the cationic colloidal silica particles. When the content is 3 parts by mass or more, it can be well prevented that the glossiness and damage resistance of the resulting recording medium are lowered. When the content is 13 parts by mass or less, it can be well inhibited that the absorbency of the resulting recording medium is lowered.

The total amount of the polyvinyl alcohol and cationic polyurethane emulsion particles in the outermost layer coating liquid based on the total solid content in the outermost layer coating liquid is favorably controlled within a range of 6% by mass or more and 20% by mass or less. When the total amount is 6% by mass or more, it can be well prevented that the glossiness and damage resistance of the resulting recording medium are lowered. When the total amount is 20% by mass or less, it can be well inhibited that the absorbency of the resulting recording medium is lowered. The total amount is more favorably 7% by mass or more and 15% by mass or less, still more favorably 8% by mass or more and 14% by mass or less.

EXAMPLES

The present invention will hereinafter be described in more detail by the following Examples. However, the present invention is not limited to these examples. Incidentally, ink jet recording media were prepared in the following Examples and Comparative Examples.

Example 1

Preparation of Substrate

A substrate was prepared under the following conditions. A paper stock of the following composition was first adjusted with water so as to give a solid content concentration of 3.0% by mass.

| Composition of paper stock | |
|---|---|
| Pulp (80 parts by mass of Laulholz bleached kraft pulp (LBKP) having a freeness of 450 ml CSF (Canadian Criteria Freeness) and 20 parts by mass of Nadelholz bleached kraft pulp (NBKP) having a freeness of 480 ml CSF) | 100 parts by mass |
| Cationized starch | 0.60 parts by mass |
| Ground calcium carbonate | 10 parts by mass |
| Precipitated calcium carbonate | 15 parts by mass |
| Alkyl ketene dimer | 0.10 parts by mass |
| Cationic polyacrylamide | 0.030 parts by mass. |

Paper was then made from this paper stock by a Fourdrinier paper machine, subjected to 3-stage wet pressing and dried by a multi-cylinder dryer. The resultant paper was then impregnated with an aqueous solution of oxidized starch by a size press device so as to give a coating amount of 1.0 g/m$^2$, and dried. Thereafter, the paper was finished by machine calender to obtain base paper A having a basis weight of 170 g/m$^2$, a Stöckigt sizing degree of 100 seconds, a gas permeability of 50 seconds, a Bekk smoothness of 30 seconds and a Gurley stiffness of 11.0 mN.

A resin composition composed of low density polyethylene (70 parts by mass), high density polyethylene (20 parts by mass) and titanium oxide (10 parts by mass) was applied in an amount of 25 g/m$^2$ to the base paper A thus obtained. A resin composition composed of high density polyethylene (50 parts by mass) and low density polyethylene (50 parts by mass) was further applied in an amount of 25 g/m$^2$ to a back side of the base paper A, thereby obtaining a resin-coated non-gas-permeable substrate 1.

Ink Receiving Layer Coating Liquid

Alumina hydrate Disperal HP14 (trade name, product of Sasol Co.) as fine particles of inorganic alumina hydrate was added to pure water to obtain an aqueous dispersion of the alumina hydrate having a solid content concentration of 30% by mass. To this aqueous alumina hydrate dispersion, was then added methanesulfonic acid in such an amount that the mass proportion {(Mass of methanesulfonic acid/Mass of alumina hydrate)×100} amounted to 1.7% by mass, and the resultant mixture was stirred to obtain colloidal sol A. To the resultant colloidal sol A, was added Surfynol 465 (trade name, product of Nisshin Chemical Industry Co., Ltd.) as a surfactant in an amount of 0.10% by mass based on the colloidal sol A. The colloidal sol A was suitably diluted with pure water in such a manner that the solid content concentration of the alumina hydrate is 21% by mass, thereby obtaining colloidal sol B.

On the other hand, polyvinyl alcohol PVA 235 (trade name, product of Kuraray Co., Ltd., viscosity-average polymerization degree: 3,500, saponification degree: 88% by mol) as a binder was dissolved in ion-exchanged water to obtain an aqueous solution of PVA having a solid content concentration of 8.0% by mass.

To the colloidal sol B, was then added the aqueous PVA solution in such an amount that the solid content of PVA amounted to 9.0% by mass in terms of {(Solid content mass of PVA/Solid content mass of alumina hydrate)×100}, and both components were mixed. A 3.0% by mass aqueous solution of boric acid was then added in such an amount that the proportion of the boric acid amounted to 1.0% by mass in terms of solid content based on the solid content of the alumina hydrate, and these components were mixed to obtain an ink receiving layer coating liquid.

Coating Method of Ink Receiving Layer

The ink receiving layer coating liquid was applied on to the non-gas-permeable substrate 1 so as to give an absolute dry coating amount of 40 g/m$^2$. The application of the ink receiving layer coating liquid was conducted at 40° C. by means of a slide die. The coating was dried at 40° C. to prepare an ink receiving layer sheet 1 having a single ink receiving layer.

Preparation of Outermost Layer Coating Liquid

A 20% by mass aqueous dispersion slurry (trade name: SNOWTEX AK-L, product of NISSAN CHEMICAL INDUSTRIES, LTD.) of monodispersive and spherical cationic colloidal silica particles, a 5% by mass aqueous solution of polyvinyl alcohol (trade name: PVA-420, product of Kuraray Co., Ltd.) and a 30% by mass emulsion of cationic polyurethane emulsion particles (trade name: SUPER FLEX 620, product of DAI-ICHI KOGYO SEIYAKU CO., LTD.) were mixed. At this time, the respective liquids were mixed in such a manner that the cationic colloidal silica particles, polyvinyl alcohol and cationic polyurethane emulsion particles in the liquid mixture amounted to 90 parts by mass, 8 parts by mass and 5 parts by mass, respectively. The solid content concentration of the resultant solution was 0.5% by mass. The average particle size of the cationic colloidal silica particles as determined by the BET method was 45 nm, the polyvinyl alcohol had a saponification degree of 80% by mol and a viscosity-average polymerization degree of 2,000, and the average particle size of the cationic polyurethane emulsion particles was 30 nm.

A surfactant (trade name: INOGEN TDX-50, product of DAI-ICHI KOGYO SEIYAKU CO., LTD.) was added to the resultant liquid mixture so as to give a solid content of 0.005% by mass based on the total mass of the coating liquid, thereby obtaining an outermost layer coating liquid. The content of the polyvinyl alcohol in the resultant outermost layer coating liquid was 5.6 parts by mass per 100 parts by mass of the cationic colloidal silica particles. The content of the cationic polyurethane emulsion particles in the outermost layer coating liquid was 5.6 parts by mass per 100 parts by mass of the cationic colloidal silica particles. Incidentally, the cationic colloidal silica particles in the 20% by mass aqueous dispersion slurry of the cationic colloidal silica were photographed by means of a scanning electron microscope to observe 100 particles and determine the major axis (a) and the minor axis (b) (each, determined as an average value) of the particles. As a result, the ratio (b/a) of the major to minor axis was 0.91.

Formation of Outermost Layer

The outermost layer coating liquid was applied on to the ink receiving layer of the ink receiving layer sheet 1 by a slide die so as to give an absolute dry coating amount of 0.1 g/m$^2$, and dried at 60° C. to obtain an ink jet recording medium 1.

Example 2

An ink jet recording medium 2 was obtained in the same manner as in Example 1 except that the absolute dry coating amount of the outermost layer coating liquid was changed to 0.2 g/m$^2$.

Example 3

An ink jet recording medium 3 was obtained in the same manner as in Example 1 except that the absolute dry coating amount of the outermost layer coating liquid was changed to 0.4 g/m$^2$.

Example 4

An ink jet recording medium 4 was obtained in the same manner as in Example 2 except that the amounts of the cationic colloidal silica particles, polyvinyl alcohol and cationic polyurethane emulsion particles in the outermost layer coating liquid were changed to 92 parts by mass, 4 parts by mass and 4 parts by mass, respectively. The content of the polyvinyl alcohol in the resultant outermost layer coating liquid was 4.3 parts by mass per 100 parts by mass of the cationic colloidal silica particles. The content of the cationic polyurethane emulsion particles in the outermost layer coating liquid was 4.3 parts by mass per 100 parts by mass of the cationic colloidal silica particles.

Example 5

An ink jet recording medium 5 was obtained in the same manner as in Example 2 except that the amounts of the cationic colloidal silica particles, polyvinyl alcohol and cationic polyurethane emulsion particles in the outermost layer coating liquid were changed to 86 parts by mass, 7 parts by mass and 7 parts by mass, respectively. The content of the polyvinyl alcohol in the resultant outermost layer coating liquid was 8.1 parts by mass per 100 parts by mass of the cationic colloidal silica particles. The content of the cationic polyurethane emulsion particles in the outermost layer coating liquid was 8.1 parts by mass per 100 parts by mass of the cationic colloidal silica particles.

Example 6

An ink jet recording medium 6 was obtained in the same manner as in Example 2 except that the amounts of the cationic colloidal silica particles, polyvinyl alcohol and cationic polyurethane emulsion particles in the outermost layer coating liquid were changed to 83 parts by mass, 7 parts by mass and 10 parts by mass, respectively. The content of the polyvinyl alcohol in the resultant outermost layer coating liquid was 8.4 parts by mass per 100 parts by mass of the cationic colloidal silica particles. The content of the cationic polyurethane emulsion particles in the outermost layer coating liquid was 12 parts by mass per 100 parts by mass of the cationic colloidal silica particles.

Example 7

The polyvinyl alcohol in the outermost layer coating liquid was changed to polyvinyl alcohol having a saponification degree of 80% by mol and a viscosity-average polymerization degree of 1,700. Specifically, an ink jet recording medium 7 was obtained in the same manner as in Example 2 except that an aqueous solution (trade name: PVA-417, product of Kuraray Co., Ltd.) was used in place of PVA-420.

Example 8

The cationic polyurethane emulsion particles in the outermost layer coating liquid were changed to cationic polyurethane emulsion particles having an average particle size of 10 nm. Specifically, an ink jet recording medium 8 was obtained in the same manner as in Example 2 except that a 26% by mass emulsion (trade name: SUPER FLEX 650, product of DAI-ICHI KOGYO SEIYAKU CO., LTD.) of cationic polyurethane emulsion particles was used in place of SUPER FLEX 620 (product of DAI-ICHI KOGYO SEIYAKU CO., LTD.).

Example 9

The cationic polyurethane emulsion particles in the outermost layer coating liquid were changed to cationic polyurethane emulsion particles having an average particle size of 70 nm. Specifically, an ink jet recording medium 9 was obtained in the same manner as in Example 2 except that a 21% by mass emulsion (trade name: HYDRAN CP-7060, product of DIC CORPORATION) of cationic polyurethane emulsion particles was used in place of SUPER FLEX 620 (product of DAI-ICHI KOGYO SEIYAKU CO., LTD.).

Example 10

An ink jet recording medium 10 was obtained in the same manner as in Example 2 except that the amounts of the cationic colloidal silica particles, polyvinyl alcohol and cationic polyurethane emulsion particles in the outermost layer coating liquid were changed to 94 parts by mass, 3 parts by mass and 3 parts by mass, respectively. The content of the polyvinyl alcohol in the resultant outermost layer coating liquid was 3.2 parts by mass per 100 parts by mass of the cationic colloidal silica particles. The content of the cationic polyurethane emulsion particles in the outermost layer coating liquid was 3.2 parts by mass per 100 parts by mass of the cationic colloidal silica particles.

Example 11

An ink jet recording medium 11 was obtained in the same manner as in Example 1 except that the absolute dry coating amount of the outermost layer coating liquid was changed to 0.05 g/m$^2$.

Example 12

An ink jet recording medium 12 was obtained in the same manner as in Example 1 except that the absolute dry coating amount of the outermost layer coating liquid was changed to 0.5 g/m$^2$.

Example 13

An ink jet recording medium 13 was obtained in the same manner as in Example 2 except that the amounts of the cationic colloidal silica particles, polyvinyl alcohol and cationic polyurethane emulsion particles in the outermost layer coating liquid were changed to 80 parts by mass, 10 parts by mass and 10 parts by mass, respectively. The content of the polyvinyl alcohol in the resultant outermost layer coating liquid was 12.5 parts by mass per 100 parts by mass of the cationic colloidal silica particles. The content of the cationic polyurethane emulsion particles in the outermost layer coating liquid was 12.5 parts by mass per 100 parts by mass of the cationic colloidal silica particles.

Comparative Example 1

An ink jet recording medium 14 was obtained in the same manner as in Example 1 except that no outermost layer coating liquid was applied.

Comparative Example 2

An ink jet recording medium 15 was obtained in the same manner as in Example 2 except that the amounts of the cationic colloidal silica particles and cationic polyurethane emulsion particles in the outermost layer coating liquid were changed to 90 parts by mass and 10 parts by mass, respectively, and no aqueous polyvinyl alcohol solution was added.

Comparative Example 3

An ink jet recording medium 16 was obtained in the same manner as in Example 2 except that the amounts of the cationic colloidal silica particles and polyvinyl alcohol in the outermost layer coating liquid were changed to 90 parts by mass and 10 parts by mass, respectively, and none of cationic polyurethane emulsion particles were added.

Comparative Example 4

The polyvinyl alcohol in the outermost layer coating liquid was changed to polyvinyl alcohol having a saponification degree of 88% by mol. Specifically, an ink jet recording medium 17 was obtained in the same manner as in Example 2 except that an aqueous solution of polyvinyl alcohol (trade name: PVA-220, product of Kuraray Co., Ltd.) was used in place of PVA-420.

Comparative Example 5

The polyvinyl alcohol in the outermost layer coating liquid was changed to polyvinyl alcohol having a viscosity-average polymerization degree of 2,400. Specifically, an ink jet recording medium 18 was obtained in the same manner as in Example 2 except that an aqueous solution of polyvinyl alcohol (trade name: PVA-424, product of Kuraray Co., Ltd.) was used in place of PVA-420.

Comparative Example 6

The polyvinyl alcohol in the outermost layer coating liquid was changed to polyvinyl alcohol having a viscosity-average polymerization degree of 500. Specifically, an ink jet recording medium 19 was obtained in the same manner as in Example 2 except that an aqueous solution of polyvinyl alcohol (trade name: PVA-405, product of Kuraray Co., Ltd.) was used in place of PVA-420.

Comparative Example 7

The cationic colloidal silica particles in the outermost layer coating liquid were changed to cationic colloidal silica particles having an average particle size of 15 nm. Specifically, an ink jet recording medium 20 was obtained in the same manner as in Example 2 except that cationic colloidal silica (trade name: SNOWTEX AK, product of NISSAN CHEMICAL INDUSTRIES, LTD.) was used in place of SNOWTEX AK-L (product of NISSAN CHEMICAL INDUSTRIES, LTD.).

Comparative Example 8

The cationic colloidal silica particles in the outermost layer coating liquid were changed to cationic colloidal silica particles having an average particle size of 70 nm. Specifically, an ink jet recording medium 21 was obtained in the same manner as in Example 2 except that cationic colloidal silica (trade name: SNOWTEX AK-YL, product of NISSAN CHEMICAL INDUSTRIES, LTD.) was used in place of SNOWTEX AK-L (product of NISSAN CHEMICAL INDUSTRIES, LTD.).

Comparative Example 9

The cationic colloidal silica particles in the outermost layer coating liquid were changed to cationic colloidal silica particles associated into the form of a string of beads, which were not monodispersive. Specifically, cationic colloidal silica (trade name: SNOWTEX PS-S-AK, product of NISSAN CHEMICAL INDUSTRIES, LTD.) was used in place of SNOWTEX AK-L (product of NISSAN CHEMICAL INDUSTRIES, LTD.). The average particle size of particles making up the colloidal silica in the form of the string of beads was determined by the BET method and found to be 10 nm. An ink jet recording medium 22 was obtained in the same manner as in Example 2 except for the above.

Comparative Example 10

The cationic polyurethane emulsion particles in the outermost layer coating liquid were changed to anionic polyurethane emulsion particles. Specifically, an ink jet recording medium 23 was obtained in the same manner as in Example 2 except that a 20% by mass emulsion (particle size: 30 nm) (trade name: SUPER FLEX 840, product of DAI-ICHI KOGYO SEIYAKU CO., LTD.) of anionic polyurethane emulsion particles was used in place of SUPER FLEX 620 (product of DAI-ICHI KOGYO SEIYAKU CO., LTD.).

Comparative Example 11

The cationic polyurethane emulsion particles in the outermost layer coating liquid were changed to cationic polyurethane emulsion particles having an average particle size of 220 nm. Specifically, an ink jet recording medium 24 was obtained in the same manner as in Example 2 except that a 30% by mass emulsion (trade name: HYDRAN CP-7040, product of DIC CORPORATION) of cationic polyurethane emulsion particles was used in place of SUPER FLEX 620 (product of DAI-ICHI KOGYO SEIYAKU CO., LTD.).

Comparative Example 12

The cationic polyurethane emulsion particles in the outermost layer coating liquid were changed to SBR latex emulsion particles. Specifically, an ink jet recording medium 25 was obtained in the same manner as in Example 2 except that a 20% by mass emulsion (trade name: SMARTEX PA-3232, product of NIPPON A&L INC.) of SBR latex emulsion particles was used in place of SUPER FLEX 620 (product of DAI-ICHI KOGYO SEIYAKU CO., LTD.).

Comparative Example 13

The cationic colloidal silica particles in the outermost layer coating liquid were changed to anionic colloidal silica particles. Specifically, an ink jet recording medium 26 was obtained in the same manner as in Example 2 except that a 20% by mass dispersion slurry (trade name: SNOWTEX 20L, product of NISSAN CHEMICAL INDUSTRIES, LTD.) of anionic colloidal silica particles was used in place of SNOWTEX AK-L (product of NISSAN CHEMICAL INDUSTRIES, LTD.).

Comparative Example 14

The polyvinyl alcohol in the outermost layer coating liquid was changed to polyvinyl alcohol having a viscosity-average polymerization degree of 500 and a saponification degree of 74%. Specifically, an ink jet recording medium 27 was obtained in the same manner as in Example 2 except that an aqueous solution of polyvinyl alcohol (trade name: PVA-505, product of Kuraray Co., Ltd.) was used in place of PVA-420.

Evaluation of Recording Medium

The recording media obtained by the above-described process were then subjected to the following evaluations. Evaluating methods and evaluated results will be described. Evaluated results are shown collectively in Table 1.

Evaluation 1: 20° Glossiness of Recording Medium

The 20° glossiness of a recording surface (a surface on which an ink receiving layer (and an outermost layer) have been formed) of each recording medium was measured according to the method described in JIS Z 8741 and evaluated according to the following evaluation criteria. VG2000 (trade name) available from Nippon Denshoku Kogyo K.K. was used as a measuring apparatus. Evaluated results are shown in Table 1.

Evaluation criteria:

5: 50 or more;

4: 40 or more and less than 50;

3: 30 or more and less than 40;

2: 20 or more and less than 30;

1: less than 20.

Evaluation 2: Evaluation of Ink Absorbency

The ink absorbency of a recording surface (a surface having an ink receiving layer (and an outermost layer)) of each recording medium was evaluated. Printing was conducted by means of an apparatus obtained by modifying the print processing system of iP4600 (trade name, manufactured by Canon Inc.). A print pattern was investigated by using a green 64-gradation solid print (64 gradations with an increment of 6.25% duty, 0 to 400% duty; specifically, sixty-four 1-in$^2$ slid images with different duties were formed in which the duty was changed from 0 to 400% duty with an increment of 6.25% duty) by bi-directional printing in which printing is completed by reciprocating 2-pass scans at a carriage speed of 25 in/sec. The 400% duty means that 44 ng of ink is applied per 1/600 in$^2$ using an ink jet head with a 600 dpi resolution. Since the ink absorbency has correlation with beading, the ink absorbency of the recording medium was evaluated by evaluating the beading. The evaluation was visually made to determine the rank of the recording medium based on the following evaluation criteria. As apparent from Table 1, the recording media according to the present invention have sufficient ink absorbency to use even at a printing speed of a next-generation high-speed printer.

Evaluation criteria:

A: No beading is observed at 300% duty;

B: Beading is somewhat observed at 300% duty, but no beading is observed at 200% duty;

C: Beading is observed even at 200% duty.

Evaluation 3: Damage Resistance

The damage resistance of each recording medium was evaluated by means of Gakushin-Type Rubbing Tester Model II (manufactured by TESTER SANGYO CO., LTD.) prescribed in JIS L 0849 in the following manner. The recording medium as a specimen was set on a vibrating table with a recording surface (surface of an ink receiving layer (and an outermost layer)) upward, and KIMTOWEL (trade name) was installed on a friction arm of the tester on which a weight of 100 g had been placed, and rubbed against the recording medium 5 times. Thereafter, a difference in 75° gloss between the portion rubbed with KIMTOWEL in the recording surface of the recording medium and another portion was measured.

Evaluation criteria:

A: less than 5;

B: 5 or more and less than 10;

C: 10 or more.

Evaluation 4: Anti-Dusting

The anti-dusting of each recording medium was evaluated by means of Gakushin-Type Rubbing Tester Model II (manufactured by TESTER SANGYO CO., LTD.) prescribed in JIS L 0849 in the following manner. The recording medium as a specimen was set on a vibrating table with a recording surface (surface of an ink receiving layer (and an outermost layer)) upward, and a black flock paper sheet was installed on a friction arm of the tester on which a weight of 300 g had been placed, and rubbed against the recording medium 20 times. Thereafter, the black reflection densities of the portion (tested portion) rubbed with the flock paper sheet in the recording surface of the recording medium and another portion were measured by 310TR (trade name) available from X-Rite Co. to determine the black density retention from the density difference between them according to the following equation, thereby evaluating the anti-dusting based on the following evaluation criteria.

Evaluation criteria:

A: The retention is 98% or more;

B: The retention is 95% or more and less than 98%;

C: The retention is less than 95%.

Retention(%)={[Density of the tested portion]/[Density of another portion than the tested portion]}×100.

Evaluation 5: Colorability

A black solid patch was printed on a recording surface of each recording medium by means of an ink jet recording apparatus (trade name: iP4500, manufactured by Canon Inc.) by a Super Photopaper and color-correction-free mode. The optical densities of the patches thus printed were respectively measured by means of an optical reflection densitometer (trade name: 530 SPECTRAL DENSITOMETER, manufactured by X-Rite Co.).

Evaluation criteria:

5: 2.35 or more;

4: 2.25 or more and less than 2.35;

3: 2.15 or more and less than 2.25;

2: 2.05 or more and less than 2.15;

1: less than 2.05.

TABLE 1

| | Gloss | Absorbency | Damage resistance | Anti-dusting | colorability |
|---|---|---|---|---|---|
| Ex. 1 | 4 | A | A | A | 5 |
| Ex. 2 | 5 | A | A | A | 5 |
| Ex. 3 | 5 | A | A | A | 5 |
| Ex. 4 | 5 | A | A | A | 5 |
| Ex. 5 | 5 | A | A | A | 5 |
| Ex. 6 | 5 | B | A | A | 4 |
| Ex. 7 | 5 | A | A | A | 5 |
| Ex. 8 | 5 | A | A | A | 5 |
| Ex. 9 | 5 | A | A | A | 5 |
| Ex. 10 | 4 | A | A | A | 5 |
| Ex. 11 | 4 | A | B | A | 5 |
| Ex. 12 | 4 | B | A | A | 3 |
| Ex. 13 | 5 | B | A | A | 3 |
| Comp. Ex. 1 | 2 | A | C | A | 4 |
| Comp. Ex. 2 | 5 | A | B | B | 4 |
| Comp. Ex. 3 | 3 | A | A | A | 3 |
| Comp. Ex. 4 | 3 | A | A | A | 2 |
| Comp. Ex. 5 | 3 | A | A | A | 1 |
| Comp. Ex. 6 | 5 | A | B | C | 5 |
| Comp. Ex. 7 | 5 | C | A | A | 1 |
| Comp. Ex. 8 | 3 | A | B | B | 3 |
| Comp. Ex. 9 | 3 | A | B | B | 3 |
| Comp. Ex. 10 | 1 | A | C | B | 1 |
| Comp. Ex. 11 | 2 | A | B | A | 2 |
| Comp. Ex. 12 | 2 | A | A | A | 2 |
| Comp. Ex. 13 | 2 | A | A | A | 2 |
| Comp. Ex. 14 | 3 | A | B | C | 3 |

As apparent from the results shown in Table 1, the recording media of Examples 1 to 13 are evaluated as "4" or more for 20° glossiness, "B" or more for absorbency, "B" or more for damage resistance, "A" for anti-dusting and "3" or more for colorability and are satisfactorily applicable to next-generation high-speed printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-278463, filed Dec. 8, 2009, which is hereby incorporated by reference herein in its entirety.

What is claimed is:

1. A method for producing a recording medium, comprising a step of coating one or more ink receiving layers provided on at least one surface of a substrate with an outermost layer coating liquid to form an outermost layer, wherein an ink receiving layer, of the one or more ink receiving layers, which is nearest to the outermost layer contains alumina hydrate and a binder, wherein the outermost layer coating liquid contains monodispersive and spherical cationic colloidal silica particles having an average particle size between 30 nm and 60 nm, inclusive, polyvinyl alcohol having a saponification degree between 75% by mol and 85% by mol, inclusive, and a viscosity-average polymerization degree between 1,500 and 2,200, inclusive, and cationic polyurethane emulsion particles having an average particle size between 10 nm and 100 nm, inclusive.

2. The production method according to claim 1, wherein the ink receiving layer nearest to the outermost layer is formed by applying an ink receiving layer coating liquid containing the alumina hydrate and the binder.

3. The production method according to claim 1, wherein the content of the polyvinyl alcohol in the outermost layer coating liquid is between 4 parts by mass and 9 parts by mass, inclusive, per 100 parts by mass of the cationic colloidal silica particles.

4. The production method according to claim 1, wherein the content of the polyurethane emulsion particles in the outermost layer coating liquid is between 4 parts by mass and 9 parts by mass, inclusive, per 100 parts by mass of the cationic colloidal silica particles.

5. The production method according to claim 1, wherein the absolute dry coating amount of the outermost layer coating liquid is ranges from 0.2 $g/m^2$ to less than 0.4 $g/m^2$.

6. The production method according to claim 1, wherein the substrate is a non-gas-permeable substrate.

7. A recording medium obtained by the method for producing a recording medium according to claim 1.

* * * * *